US007434336B2

(12) United States Patent
Kosted

(10) Patent No.: US 7,434,336 B2
(45) Date of Patent: Oct. 14, 2008

(54) FOOTWEAR INCORPORATING A SELF-LOCKING SOCK

(76) Inventor: Dale Kosted, 3502 King St., Enid, OK (US) 73703

( * ) Notice: Subject to any disclaimer, the term of this patent is extended or adjusted under 35 U.S.C. 154(b) by 304 days.

(21) Appl. No.: 10/893,055

(22) Filed: Jul. 19, 2004

(65) Prior Publication Data

US 2005/0011083 A1 Jan. 20, 2005

Related U.S. Application Data

(60) Provisional application No. 60/493,954, filed on Aug. 8, 2003, provisional application No. 60/488,276, filed on Jul. 19, 2003.

(51) Int. Cl.
*A43B 17/18* (2006.01)

(52) U.S. Cl. ..... 36/10; 36/55; 36/58.5; 36/80

(58) Field of Classification Search ..... 36/80, 36/55, 10, 58.5, 58.6, 89, 114; 2/240
See application file for complete search history.

(56) References Cited

U.S. PATENT DOCUMENTS

| | | | | | |
|---|---|---|---|---|---|
| 2,391,064 | A * | 12/1945 | Stokes | 2/239 |
| 4,377,913 | A * | 3/1983 | Stone | 36/99 |
| 4,575,954 | A * | 3/1986 | Bye | 36/89 |
| 4,645,466 | A * | 2/1987 | Ellis | 441/74 |
| 5,092,347 | A * | 3/1992 | Shaffer et al. | 128/892 |
| 5,259,126 | A * | 11/1993 | Rosen | 36/93 |
| 5,595,005 | A * | 1/1997 | Throneburg et al. | 36/91 |
| 5,724,753 | A * | 3/1998 | Throneburg et al. | 36/91 |
| 6,880,268 | B2 * | 4/2005 | Chen | 36/43 |
| 2001/0018805 | A1 * | 9/2001 | Basso | 36/10 |

* cited by examiner

*Primary Examiner*—Marie Patterson

(57) ABSTRACT

Footwear, incorporating a self-locking sock for stopping the slippage of a user's foot inside the shoe while walking or running. The footwear with a self-locking sock comprises: a footwear with two male portions of hook and loop fasteners with one attached to the inner side of the tongue and the other attached to the insole, and a sock with two female portions of hook and loop fastener with one attached to the instep and the other attached to the sole.

2 Claims, 2 Drawing Sheets

FOOTWEAR INCORPORATING A SELF-LOCKING SOCK

CROSS-REFERENCE TO RELATED APPLICATIONS

This application is entitled to the benefit of Provisional Patent Applications Nos. 60/493,954 filed Aug. 8, 2003 and 60/488,276 filed on Jul. 19, 2003.

FIELD OF THE INVENTION

The present invention relates to footwear and more particularly relates to a new footwear with incorporating a self-locking sock for preventing the slippage of a user's foot while walking or running. This invention relates generally to footwear, and more specifically pertains to a running, athletic, walking shoe or footwear in general, wherein the inner side of the tongue of a the has a male portion, (i.e., hook), of hook and loop fastener attached to the inner side and the insole has a male portion, (i.e., hook), of hook and loop fastener attached so that the corresponding female halves of the hook and loop fastener which are attached to the instep and the sole of the sock mate holding the foot of a wearer securely in place preventing slippage. And, providing a shoe which offers differing styles to the advantage of its wearer.

BACKGROUND OF THE INVENTION

The present inventive device includes a footwear with a male portion of hook and loop fastener attached to the inner side of the tongue, and a male portion of hook and loop fastener attached to the insole, and a sock having two female portions of hook and loop fastener with one attached to the instep and the other attached to its sole. In these respects, Footwear with a self-locking sock according to the present invention greatly differs from known concepts and designs of the prior art, and in doing so provides an apparatus primarily developed for the purpose of preventing the slippage of the foot inside said footwear while walking or running. The present invention provides a novel footwear which prevents a wide number of common maladies suffered such as blisters, black-toe, calluses, etc.

BRIEF SUMMARY

Reviewing the disadvantages inherent in the known types of footwear now present in the prior art, the present invention provides a new footwear incorporating a self-locking sock construction wherein the same can be utilized for the prevention of slippage of the users foot inside said footwear while walking or running. Thus, the prevention of foot slippage will solve many problems common to the user.

The general purpose of the present invention is to provide a new footwear with a self-locking sock apparatus and method which has many advantages of the footwear known in prior art and many novel features that result which is not anticipated, rendered, obvious, suggested, or even implied by any of the prior art footwear, either alone or in any combination thereof.

To attain this, the present invention generally comprises: a footwear with two male portions of hook and loop fasteners of predetermined length with one attached, (i.e., by means of sewing or gluing), to the inner side of the tongue and the other attached, (i.e., by means of sewing or gluing), to the insole, and a sock which is constructed out of moisture-wicking yarns (i.e., acrylics, nylon, or micro-blended yarns), with an ankle portion, a foot portion and two strips of predetermined length of hook and loop fasteners with each strip having a female loop half. The foot portion has a heel, an instep, a sole, and a toe which is constructed out of a stretchable fabric (i.e, such as Lycra, Spandex, Poly-Spandex, Nylon-Spandex, Cotton-Spandex), which is woven into or attached. (i.e. sewn), to said foot portion of sock. The foot portion comprises a sole which has attached, (i.e., sewn), to the outer-side of said sole portion the female loop half of one of said hook and loop fastener to which is mated with the corresponding male hook half of said hook and loop fastener which is attached to the insole of said footwear, and an instep which has attached, (i.e., sewn), to the outer-side the female loop half of said second strip of hook and loop fastener which is mated with the corresponding male hook half of said second strip of hook and loop fastener attached to the inner side of said tongue of said footwear.

In application the user places his foot in said footwear, as normal, and the hook and loop fasteners of said footwear and sock mate to hold the foot securely in place. Thus, said footwear incorporating a self-locking sock prevents the user's foot from slipping around, (e.g., forward, backward, or sideways), causing several different types of known foot problems. Anchoring the user's foot inside said footwear at two points said sock functions as a sling preventing the forward motion of the user's foot from impacting end of said footwear by absorbing the energy generated by sudden stoppage.

BRIEF DESCRIPTION OF THE DRAWINGS

Footwear incorporating a self-locking sock of this invention will be described in more detail with reference to the accompanying drawings, which illustrate a specific embodiment of the invention.

DETAILED DESCRIPTION OF THE DRAWINGS

Figure 1:
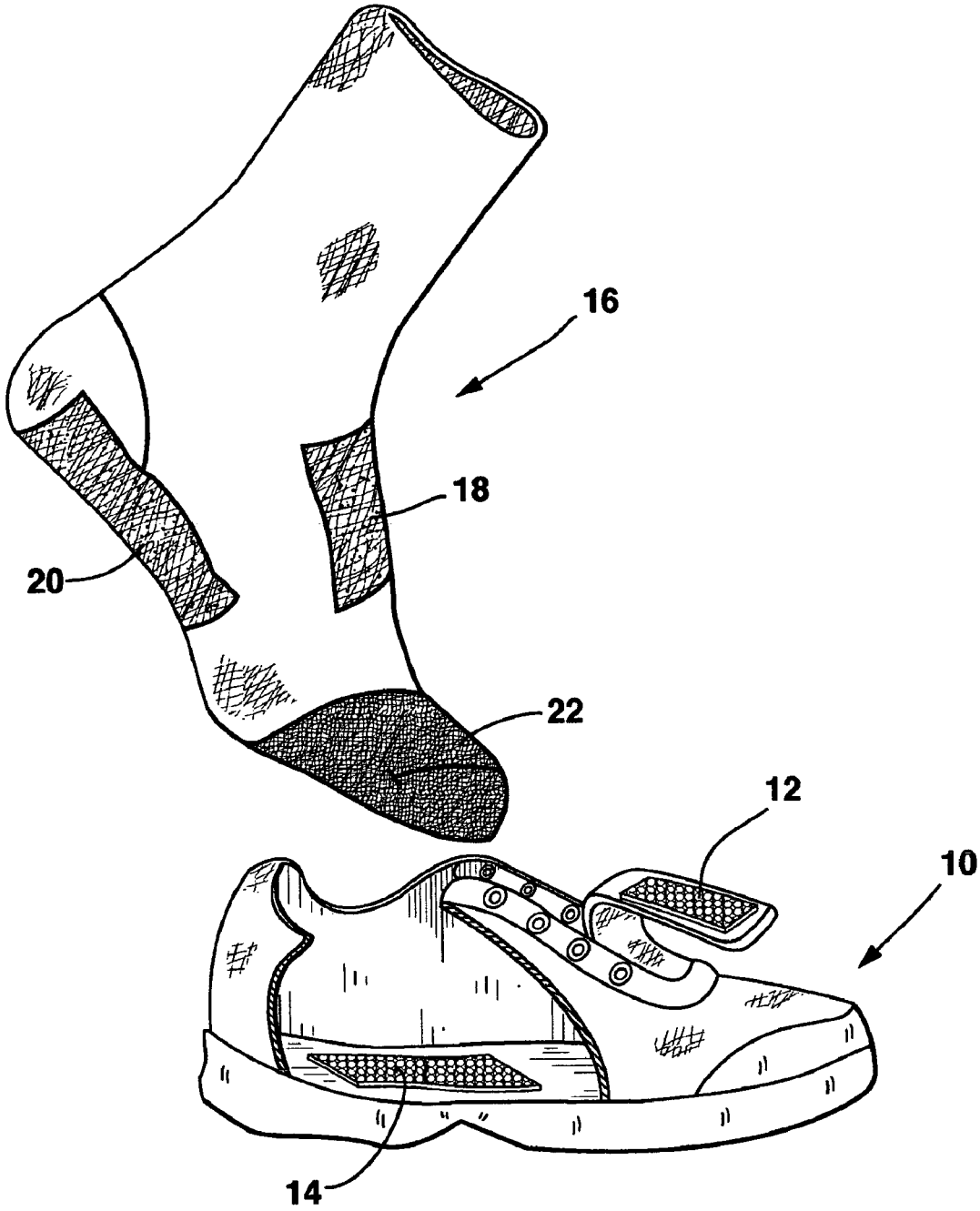
FIG. 1 is a cut-away view of said footwear, (i.e., shoe), showing the placement of the male portions of the hook and loop fasteners attached to the insole of the shoe and the inner side of the tongue, and showing the sock with the placement of the female portions of the hook and loop fastener attached to its instep and sole. A toe portion of said sock constructed out of a stretchable fabric is shown.

With reference to the accompanying drawings, the same parts are identified by the same reference numeral in all figures of the drawings.

In FIG. 1, a specific embodiment of the Footwear with a self-locking sock of the present invention, indicated generally by reference numeral 10. A male portion of hook and loop fastener by reference numeral 12 attached to the inner side of the tongue of said footwear. A male portion of hook and loop fastener by reference numeral 14 attached to the insole of said footwear. The sock of the present invention by reference numeral 16. A female portion of hook and loop fastener attached to the instep of the sock by reference numeral 18. A female portion of hook and loop fastener attached to the sole of the sock by reference numeral 20. A toe portion, constructed out of a stretchable fabric attached to the sock by reference numeral 22.

Figure 2:
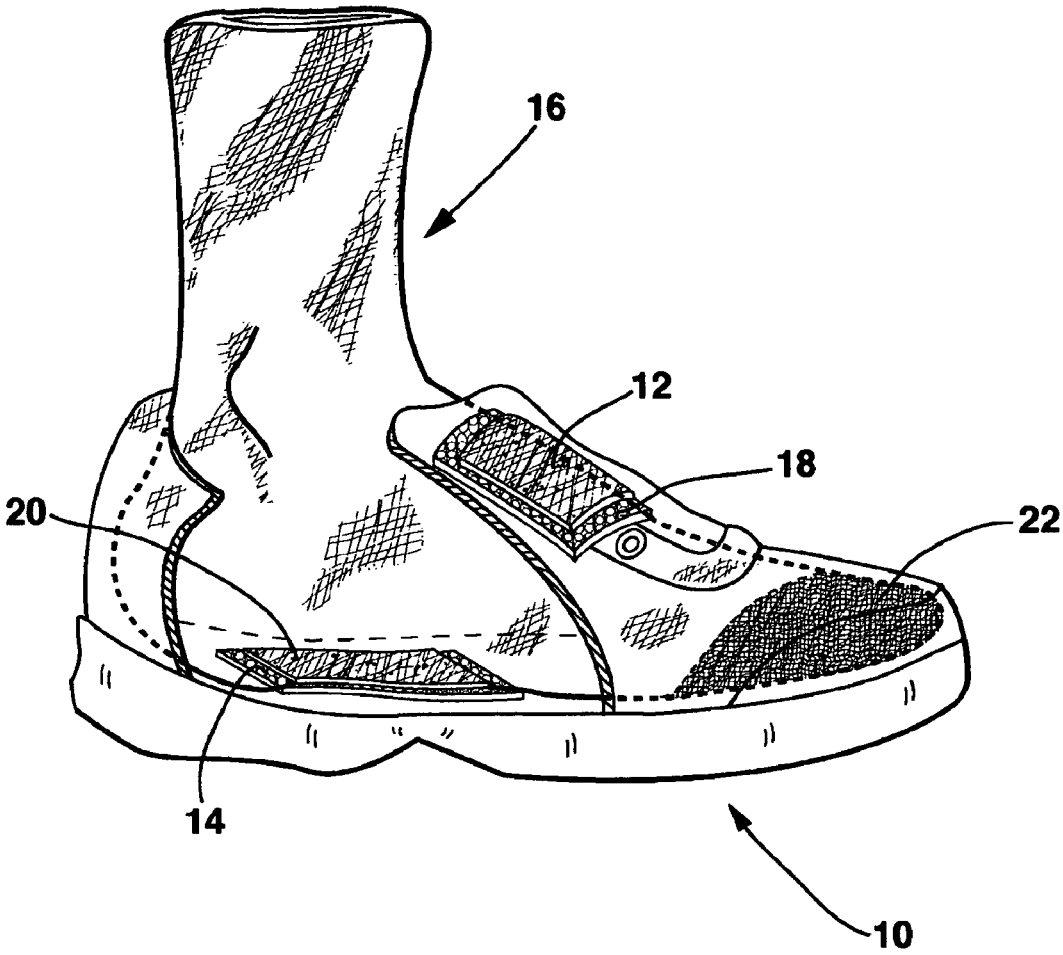
FIG. 2 is a cut-away view of said footwear, (i.e., shoe), showing a user wearing said self-locking socking with his foot placed in said footwear, and showing the mating of said male portions of hook and loop fasteners with said female portions of hook and loop fasteners thereby preventing the user's foot from slipping around inside said footwear.

In FIG. 2 The sock of the present invention by reference numeral 16 is shown being worn by a user with foot his placed in said footwear 10. Said male portion of hook and loop fastener 12 attached to the tongue is shown mated with said female portion of hook and loop fastener 18 attached to the instep of said sock, and said male portion of hook and loop fastener 14 attached to the insole is shown mated with said female portion of hook and loop fastener 20 attached to the sole of said sock. A toe portion, constructed out of a stretchable fabric attached to the sock by reference numeral 22.

I claim:

1. A footwear comprising:

a sole;

a midsole;

an insole;

an upper attached to the sole;

a tongue attached to the upper;

two strips of predetermined length of male portion of hook and loop fastener;

two strips of predetermined length of female portion of hook and loop a self-locking sock;

wherein a wearer places his foot in the inside of said sock and the two strips of female portion of hook and loop fastener, one on the instep and second on the sole, mate with the two strips of male portion of hook and loop fastener, one on the inner side of the tongue and second on the insole, when wearer places his foot inside the footwear.

2. A footwear comprising: a sole; a midsole, an insole with two sides which are a top side and a bottom side, and a toe portion, a shank portion, a heel portion, and a strip of predetermined length of male portion of hook and look fastener attached to the top side of the insole on the shank portion proximal the heel portion; an upper; a tongue attached to the upper, and the tongue has an outer side and an inner side with a second strip of predetermined length of male portion of hook and loop fastener attached to the inner side;

and a self-locking sock with an inside, an outside, an ankle portion, a foot portion consisting of toe portion constructed out of a stretchable fabric, an instep portion with a strip of predetermined length of female portion of hook and loop fastener attached to the outside of the self-locking sock, a heel portion, and a sole portion with a second strip of predetermined length of female portion of hook and loop fastener attached to said outside proximal the heel portion.

* * * * *